US006619262B2

(12) United States Patent
Graf et al.

(10) Patent No.: US 6,619,262 B2
(45) Date of Patent: Sep. 16, 2003

(54) METHOD FOR CONTROLLING AN INTERNAL COMBUSTION ENGINE

(75) Inventors: Johann Graf, Hausen (DE); Michael Henn, Regensburg (DE); Gerhard Schopp, Pettendorf (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/113,165

(22) Filed: Apr. 1, 2002

(65) Prior Publication Data

US 2002/0121268 A1 Sep. 5, 2002

Related U.S. Application Data

(63) Continuation of application No. PCT/DE00/01846, filed on Jun. 7, 2000.

(30) Foreign Application Priority Data

Sep. 30, 1999 (DE) ..... 199 47 037

(51) Int. Cl.[7] ..... F02M 7/00
(52) U.S. Cl. ..... 123/435; 123/673
(58) Field of Search ..... 123/434, 673, 123/672, 674, 435

(56) References Cited

U.S. PATENT DOCUMENTS 5,067,460 A * 11/1991 Van Duyne ..... 123/337
5,107,815 A * 4/1992 Van Duyne ..... 123/435
5,515,828 A 5/1996 Cook et al.

FOREIGN PATENT DOCUMENTS

DE 38 39 611 A1 5/1990
DE 42 44 550 A1 7/1994
DE 297 12 502 U1 10/1997
EP 0 376 714 A2 7/1990
WO WO 90/07051 6/1990

OTHER PUBLICATIONS

Patent Abstracts of Japan No. 01–106958 (Tatsuyuki), dated Apr. 24, 1989.

Patent Abstracts of Japan No. 62–017342 (Masaki), dated Jan. 26, 1987.

Patent Abstracts of Japan No. 11–062639 (Takashige), dated Mar. 5, 1999.

* cited by examiner

*Primary Examiner*—Bibhu Mohanty
(74) *Attorney, Agent, or Firm*—Laurence A. Greenberg; Werner H. Stemer; Gregory L. Mayback

(57) ABSTRACT

An internal combustion engine having cylinders with injection valves and air mass-setting actuators, an air/fuel ratio sensor detecting the ratio in the individual cylinders, and a sensor detecting a torque generated in the individual cylinders or differences in the torques generated in the cylinders includes individually determining the air/fuel ratio for each cylinder, individually correcting an activation of the fuel injection valve for each cylinder as a function of the detected air/fuel ratio and of a desired value of the air/fuel ratio, determining the variable characterizing the torque or the differences in the torque for each cylinder, individually correcting an activation of the air mass-setting actuator for each cylinder as a function of the detected value of the variable characterizing the torque or of the variable characterizing the difference in the torque specifically with the effect of assimilating the torques generated by the individual cylinders.

18 Claims, 3 Drawing Sheets

METHOD FOR CONTROLLING AN INTERNAL COMBUSTION ENGINE

CROSS-REFERENCE TO RELATED APPLICATION

This application is a continuation of copending International Application PCT/DE00/01846, filed Jun. 7, 2000.

BACKGROUND OF THE INVENTION

Field of the Invention

The invention relates to a method for controlling an internal combustion engine, in particular, an internal combustion engine with quantity control, that is to say, an internal combustion engine operating on the Otto principle.

In a prior art method for controlling an internal combustion engine disclosed in German Published, Non-Prosecuted Patent Application DE 38 39 611 A1, the air ratio is determined individually for each cylinder by a lambda probe. As a function of the air ratio determined for the respective cylinder, a correction signal for correcting the activation of a fuel injection valve is determined, specifically with the effect of an approximation of all the air ratios in the respective cylinders of the internal combustion engine to the value $\lambda=1$.

Alternatively thereto, German Published, Non-Prosecuted Patent Application DE 38 39 611 A1 discloses, a determination of a correction signal for activating an actuator of a throttle member of the internal combustion engine as a function of the respective individual-cylinder air ratio.

The disadvantage of both alternatives of the prior art methods, however, is that, although the air/fuel ratios in the individual cylinders are approximated to one another, the torques generated in the individual cylinders may vary, and the variation is detected by a driver of a vehicle in which the internal combustion engine is disposed as an unevenly running internal combustion engine or as jolting.

In a further prior art method disclosed in International publication WO 90/07051, corresponding to U.S. Pat. No. 4,936,277 to Deutsch, the torque contributions of the individual cylinders of the internal combustion engine are assimilated to one another by a monitoring of the power output by the respective cylinders and individual-cylinder correction of the fuel mass as a function of the respective power in the cylinder. Although, by such a method, an assimilation of the torque contributions of the individual cylinders is achieved, the method may lead to deviations in the air ratio in individual cylinders from a predetermined desired value for the air ratio, these deviations being capable of causing damage to a three-way catalytic converter disposed in an exhaust tract of the internal combustion engine.

SUMMARY OF THE INVENTION

It is accordingly an object of the invention to provide a method for controlling an internal combustion engine that overcomes the hereinafore-mentioned disadvantages of the heretofore-known devices and methods of this general type and that ensures low-emission and at the same time comfortable control of an internal combustion engine.

With the foregoing and other objects in view, there is provided, in accordance with the invention, a method for controlling an internal combustion engine having cylinders each with at least one fuel injection valve and at least one actuator setting a mass of air supplied to the cylinder, including the steps of detecting an air/fuel ratio in a cylinder and individually determining an air/fuel variable for each cylinder, detecting a torque generated in a cylinder and individually determining a torque variable for each cylinder, individually correcting an activation of the fuel injection valve for each cylinder as a function of a detected quantity of the air/fuel variable for each cylinder and a desired value of the air/fuel variable, and individually correcting an activation of the air mass-setting actuator for each cylinder as a function of a detected value of the torque variable to effect an assimilation of the torques generated by the individual cylinders.

With the objects of the invention in view, there is also provided a method for controlling an internal combustion engine having cylinders each with at least one fuel injection valve and at least one actuator setting a mass of air supplied to the cylinder, including the steps of detecting an air/fuel ratio in a cylinder and individually determining an air/fuel variable for each cylinder, detecting a torque difference variable representing differences between torques generated in the cylinders and individually determining the torque difference variable for each cylinder, individually correcting an activation of the fuel injection valve for each cylinder as a function of a detected quantity of the air/fuel variable for each cylinder and a desired value of the air/fuel variable, and individually correcting an activation of the air mass-setting actuator for each cylinder as a function of a detected value of the torque difference variable to effect an assimilation of the torques generated by the individual cylinders.

In accordance with another mode of the invention, the torque variable is the torque.

In accordance with a further mode of the invention, the cylinder has a combustion space and the torque variable is a combustion space pressure.

In accordance with an added mode of the invention, the air/fuel ratio is detected with at least one sensor.

In accordance with an additional mode of the invention, the torque is detected with at least one sensor.

In accordance with yet another mode of the invention, the torque difference is detected with at least one sensor.

In accordance with yet a further mode of the invention, the air mass-setting actuator is a gas exchange valve.

In accordance with yet an added mode of the invention, an air/fuel ratio is detected in all of the cylinders and an air/fuel variable is individually determined for each cylinder.

In accordance with yet an additional mode of the invention, a torque generated is detected in all of the cylinders and a torque variable is individually determined for each cylinder.

In accordance with again another mode of the invention, a torque difference variable representing differences between torques generated in all of the cylinders is detected and the torque difference variable is individually determined for each cylinder.

In accordance with again a further mode of the invention, the engine has a crankshaft connected to the cylinders, and the torque difference variable is derived from a rotational speed of the crankshaft.

In accordance with a concomitant mode of the invention, the torque difference variable is derived from a measurement signal of a combustion space pressure sensor.

Other features that are considered as characteristic for the invention are set forth in the appended claims.

Although the invention is illustrated and described herein as embodied in a method for controlling an internal combustion engine, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Elements with the same configuration and functioning are given the same reference symbols throughout the figures.

Figure 1:
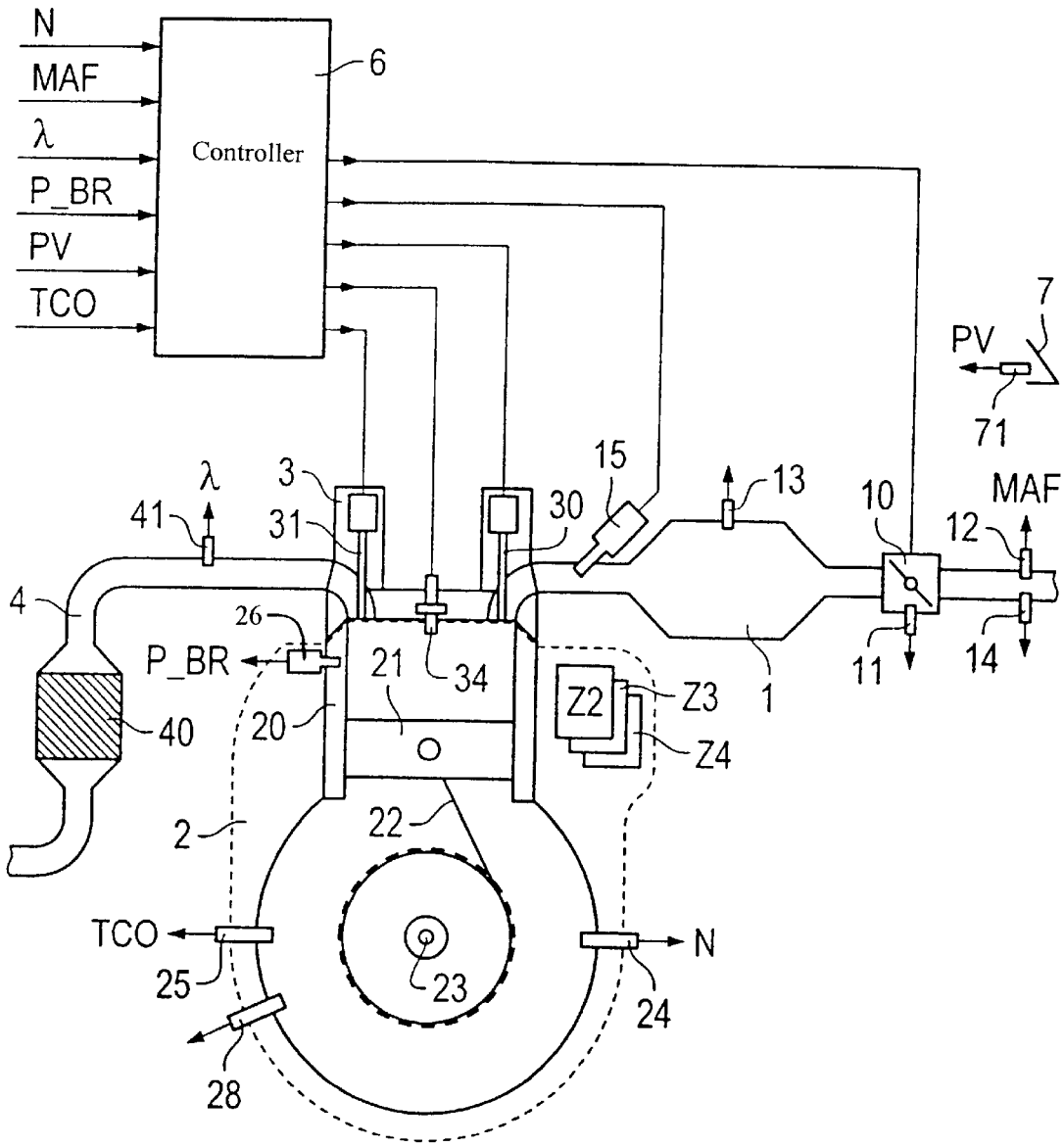
FIG. 1 is a fragmentary, block circuit and diagrammatic illustration of an internal combustion engine with a control device according to the invention.

An internal combustion engine diagrammatically illustrated in FIG. 1 includes an intake tract associated with a throttle valve 10 and at least one injection valve 15, and an engine block 2 having a cylinder 20 and a crankshaft 23. A piston 21 and a connecting rod 22 are associated with the cylinder 20. The connecting rod 22 is connected to the piston 21 and the crankshaft 23. The injection valve 15 is provided either for the injection of fuel into a plurality of cylinders of the internal combustion engine or only for the injection of fuel respectively into one cylinder of the internal combustion engine. In the latter instance, each cylinder 20 of the internal combustion engine has an injection valve 15. The injection valve 15 may alternatively also be provided in a cylinder head 3 and be disposed such that the fuel is metered directly into the combustion space of the cylinder 20. Alternatively, the injection valve 15 may also be disposed toward a mixing chamber of a mixture injector that blows the air/fuel mixture out of the mixing chamber directly into the cylinder 20.

Furthermore, a valve gear, with at least one inlet valve 30 and one outlet valve 31, is disposed in the cylinder head 3. The valve gear includes at least one non-illustrated camshaft with a transmission device that transmits the cam stroke to the inlet valve 30 or the outlet valve 31. Preferably, devices for adjusting the valve stroke times and/or the valve stroke profile are also provided. Such a device for adjusting the valve stroke profile of a gas exchange valve is disclosed in German Published, Non-Prosecuted Patent Application DE 42 44 550 A1, corresponding to U.S. Pat. No. 5,586,527 to Kreuter and is used preferably for the throttle-free load control of gasoline engines. The device has two camshafts that lie in opposition and act on the gas exchange valve through a rocker arm. One of the camshafts determines the opening function and the other camshaft the closing function of the gas exchange valve. The valve stroke profile of the gas exchange valve, that is to say, the stroke and the opening duration, can be varied within wide ranges by relative rotation of the two camshafts in relation to one another by a four-wheel coupling mechanism. A corresponding actuating drive is provided for setting the relative rotation.

Alternatively, an electromechanical actuator may also be provided, which controls the valve stroke profile of the inlet or outlet valve 30, 31. Such an electromechanical actuator is disclosed, for example, in German Utility Model DE 297 12 502 U1, corresponding to U.S. Pat. No. 6,078,235 to Schebitz et al. The actuator includes a spring mass oscillator with an armature and two electromagnets. Such an armature acts on the gas exchange valves, that is to say, on the inlet valve 30 or the outlet valve 31. When an electromechanical actuator is provided for controlling the gas exchange valves, there is no camshaft present.

Furthermore, a spark plug 34 is introduced into the cylinder head 3. The internal combustion engine is illustrated in FIG. 1 with one cylinder 20. However, further cylinders Z2, Z3, Z4 are also included and are shown diagrammatically in FIG. 1. The cylinders Z2 to Z4 are preferably configured identically to the cylinder 20. Furthermore, they are also in each case associated with at least one outlet valve 31 and one inlet valve 30.

An exhaust tract 4 with a catalytic converter 40 and with an oxygen probe 41 is associated with the internal combustion engine. A control device 6 is connected to sensors that detect various measurement variables and respectively determine a measurement value of a measurement variable. The control device 6 determines, as a function of at least one measurement variable, one or more regulating signals that respectively control a regulator. The sensors include a pedal position transmitter 71 that detects a pedal position of the accelerator pedal 7, a throttle valve position transmitter 11 that detects a degree of opening of the flap of the throttle valve 10, an air mass meter 12 that detects an air mass flow MAF, a suction pipe pressure sensor 14 that detects a suction pipe pressure in the intake tract 1, a first temperature sensor 13 that detects an intake air temperature, a rotational speed sensor 24 that detects a rotational speed N of the crankshaft 23, a second temperature sensor 25 that detects a coolant temperature TCO, a combustion space pressure sensor 26 that detects the pressure P_BR in the interior of the cylinder 20, that is to say, in the combustion space, and/or the oxygen probe 41 that detects the residual oxygen content of the exhaust gas in the exhaust tract 4 and associates it with the measurement value of the air ratio $\lambda$. The air ratio $\lambda$ is the ratio of the air mass supplied to the cylinder 20 to the theoretical air requirement for stoichiometric ratios in the case of the injected fuel quantity. The air ratio is, therefore, a variable characterizing the air/fuel ratio.

Preferably, furthermore, a torque sensor 28 is provided that detects at the crankshaft 23 the torque generated in the individual cylinders 20, Z2–Z4. Depending on the embodiment of the invention, any desired subset of the sensors or additional sensors may be present.

The regulators each include an actuating drive and an actuator. The actuating drive is an electromotive drive, an electromagnetic drive or a further drive conventional to a person skilled in the art. The actuators are configured as a throttle valve 10, as an injection valve 15, as a spark plug 34, or as a device for adjusting the valve stroke of the inlet or outlet valves 30, 31, or as electromechanical actuators for controlling the valve stroke of the inlet and outlet valves 30, 31. The regulators are referred to hereafter in terms of the actuator respectively associated therewith.

If one of more devices for adjusting the valve stroke of the inlet or outlet valves 30, 31 or electromechanical actuators are provided for setting the air mass in the cylinders 20, Z2–Z4, then, if appropriate, the throttle valve 10 may be dispensed with. The control device 6 is preferably configured as an electronic engine control. It may, however, also include a plurality of control units that are connected electrically conductively to one another, such as, for example, through a bus system.

Figure 2:
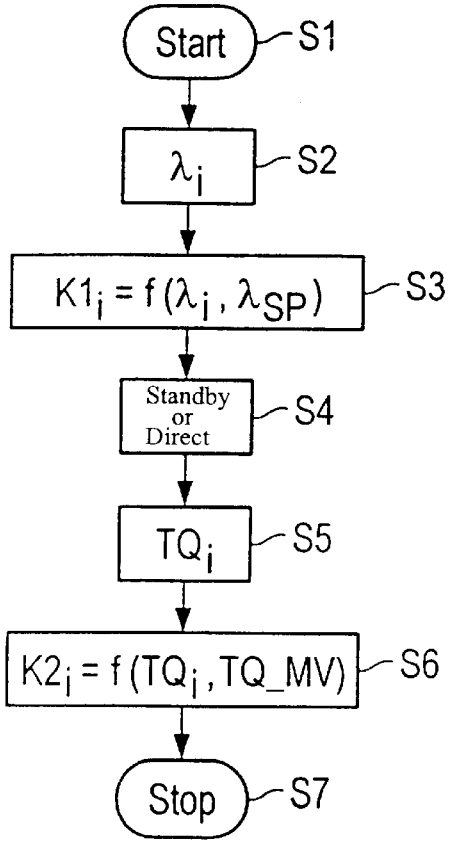
FIG. 2 is a flow diagram for cylinder assimilation according to the invention.

FIG. 2 illustrates a flow diagram of a method for controlling the internal combustion engine that brings about an assimilation of the cylinders 20, Z2 to Z4. The program is stored in the control device 6 and is run through there. The program may be run through either at predetermined time intervals during the operation of the internal combustion engine or in predetermined operating states of the internal combustion engine. Such an operating state may be, for example, stationary partial load operation or idling or be characterized in that the coolant temperature TCO exceeds a predetermined threshold value.

The program is started in a step S1. In a step S2, the air ratio $\lambda$ is determined individually for each cylinder, represented by the $\lambda_i$. In such a case, for each cylinder 20, Z2 to Z4, the air ratio $\lambda_i$ capable of being associated therewith is calculated at least once and is then a measure of the respective air/fuel ratio in the respective cylinder 20, Z2 to Z4. Alternatively, the individual-cylinder determination of the air ratio $\lambda_i$ for each cylinder may also be carried out averaged over a plurality of work cycles.

In a step S3, a first correction value $K1_i$ is determined for each of the cylinders 20, Z2 to Z4 as a function of the air ratio $\lambda_i$ assigned to the respective cylinder and a desired value $\lambda_{sp}$ of the air ratio. The desired value $\lambda_{sp}$ may, for example, be equal to one to ensure a stoichiometric air/fuel mixture in the cylinders 20, Z2 to Z4. The first correction value $K1_i$ is used, in the program illustrated in FIG. 3, for the general control of the internal combustion engine and is described in more detail further below.

In a step S4, the program may remain in a standby state for a predetermined duration or, alternatively, go directly to step S5.

In the step S5, the torque $TQ_i$ that is generated for each cylinder 20, Z2 to Z4 is determined respectively. For such a purpose, either the measurement signal of the torque sensor 28 or the measurement signal of the combustion space pressure sensor 26 is evaluated, or, for example, the measurement signal of the rotational speed transmitter 24. In such a case, average values of the torques $TQ_i$ related to the respective cylinders may also be determined over a plurality of work cycles of the internal combustion engine.

In a step S6, a second correction value $K2_i$ is calculated individually for each cylinder 20, Z2 to Z4 as a function of the torque $TQ_i$ respectively associated with a cylinder Z2 to Z4, 20 and of an average value TQ_MV of the torques that is calculated by the averaging of all the torques $TQ_i$. The second correction value $K2_i$ is used, in the general program described in FIG. 3, for controlling the internal combustion engine. The program is subsequently terminated in a step S7.

In a step S10 (FIG. 3), a main program for controlling the internal combustion engine is started. In a step S11, a desired value TQI_SP of the torque to be generated by the internal combustion engine is calculated as a function of the rotational speed N, the accelerator pedal value PV, and further operating variables of the internal combustion engine, such as the coolant temperature TCO, and further torque contributions, such as, for example, from an electronic transmission control or a traction control.

In a step S12, a fuel injection duration $T_{KSTi}$ is calculated for the injection valve or injection valves 15 individually for each cylinder. For this purpose, the fuel injection duration $T_{KSTi}$ is calculated for each cylinder 20, Z2 to Z4 as a function of the desired value for the torque, of the first correction valve $K1_i$ associated in each case, and, if appropriate, of further variables. By the fuel injection duration $T_{KSTi}$ being a function of the correction value $K1_i$ associated in each case to the cylinder 20, Z2 to Z4, it is ensured that the air/fuel ratio in all the cylinders is approximated, within narrow limits, to the predetermined desired value of the air/fuel ratio. Thereby, different fuel throughflow quantities caused in the injection valves 15 by manufacturing tolerances can be compensated.

In a step S13, a valve stroke duration $T_{VHi}$ is calculated for each individual cylinder 20, Z2 to Z4 as a function of the desired value TQI_SP of the torque, of the second correction value $K2_i$ associated with the respective cylinder 20, Z2 to Z4 and, if appropriate, of further variables. Then, depending on the embodiment of the internal combustion engine, the throttle valve 10 or electromechanical actuators or the device or devices for adjusting the valve stroke times are activated as a function of the valve stroke duration $T_{VHi}$ associated with the respective cylinder.

Alternatively, in the step S13, a maximum valve stroke or a valve stroke profile may also be determined as a control variable for activating the devices for adjusting the valve stroke profile.

By the valve stroke duration $T_{VHi}$ being a function of the second correction value $K2_i$ associated with the respective cylinder, it is ensured that the torques generated in the respective cylinders are identical.

Figure 3:
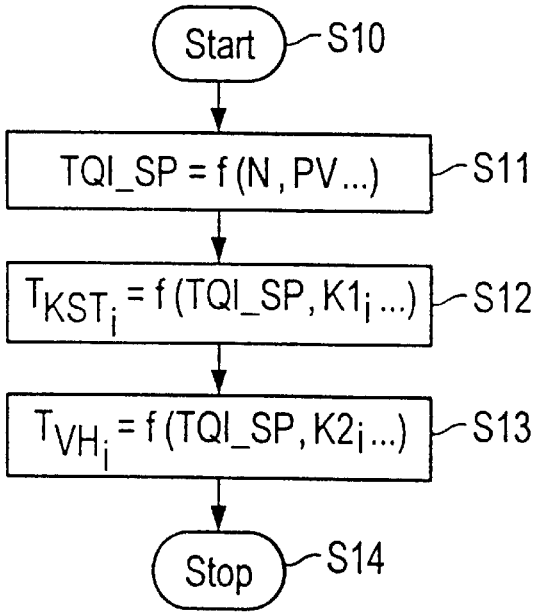
FIG. 3 is a flow diagram of a main control function in the control device according to the invention.

Thus, advantageously, the steps S12 and S13 ensure that both the air/fuel ratio in each cylinder 20, Z2 to Z4 of the internal combustion engine corresponds to the predetermined desired value and the torque generated in the respective cylinders is identical. As a result, on one hand, efficient and careful operation of the catalytic converter 40 with corresponding emission reduction is ensured and, on the other hand, a high driving comfort of a vehicle in which the internal combustion engine is disposed is ensured. The program is terminated in a step S14. The program according to FIG. 3 is retrieved preferably at predetermined time intervals or as a function of the rotational speed N.

Figure 4:
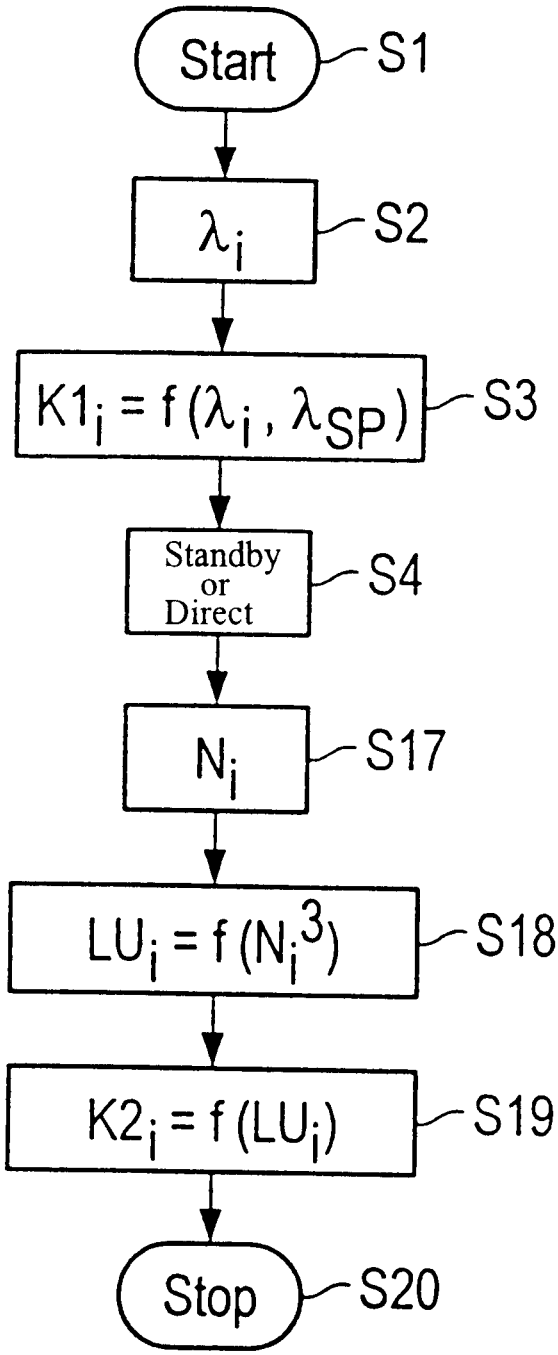
FIG. 4 is flow diagram for an alternative embodiment of cylinder assimilation according to the invention.

FIG. 4 shows a further method for assimilating the cylinders. Steps S1 to S4 are identical to the corresponding steps in FIG. 2.

In a step S17 following step S4, the rotational speed $N_i$ associated with the respective cylinder is determined individually for each cylinder 20, Z2 to Z4. In this case, for example, the respective rotational speed during the expansion stroke of the respective cylinder or in a subsequent stroke or segment is determined. A segment is defined by the time interval between the top dead centers of two cylinders that follow one another in the ignition sequence.

In a step S18, an uneven-running value $LU_i$ is determined individually for each cylinder 20, Z2 to Z4 as a function of the rotational speed $N_i$ determined for the respective cylinder 17. A function of the third power of the respective rotational speed $N_i$ has proved particularly advantageous in this case. The uneven running is a measure of differences between the torques generated in the cylinders. Alternatively, the uneven-running values $LU_i$ may also be determined as a function of a change in the rotational speed $N_i$, the change being associated with the respective cylinder.

In a step S19, the second correction value $K2_i$ is determined individually for each cylinder as a function of the respective uneven-running value $LU_i$. The determination takes place with the effect of assimilating the torques generated by the individual cylinders. If a torque sensor 28 is present, a deviation of the individual torque from the torque averaged over all the cylinders may also be calculated individually for each cylinder and the second correction value $K2_i$ then be calculated as a function of such deviation.

A corresponding procedure is also advantageous if a combustion space pressure sensor 26 is present. The program is then terminated in a step S20.

It is particularly advantageous if the actuator for setting the air mass to be supplied to the cylinders 20, Z2 to Z4 is the inlet valves 30. Such a configuration ensures that the respective air mass in the cylinders can be set with very high time resolution and with an extremely short idle time.

We claim:

1. A method for controlling an internal combustion engine having cylinders each with at least one fuel injection valve and at least one actuator setting a mass of air supplied to the cylinder, which comprises:

detecting an air/fuel ratio in a cylinder and individually determining an air/fuel variable for each cylinder;

detecting a torque generated in a cylinder and individually determining a torque variable for each cylinder;

individually correcting an activation of the fuel injection valve for each cylinder as a function of:

a detected quantity of the air/fuel variable for each cylinder; and a desired value of the air/fuel variable; and individually correcting an activation of the air mass-setting actuator for each cylinder as a function of a detected value of the torque variable to effect an assimilation of the torques generated by the individual cylinders.

2. The method according to claim 1, wherein the torque variable is the torque.

3. The method according to claim 1, wherein:

the cylinder has a combustion space; and the torque variable is a combustion space pressure.

4. The method according to claim 1, which further comprises detecting the air/fuel ratio with at least one sensor.

5. The method according to claim 1, which further comprises detecting the torque with at least one sensor.

6. The method according to claim 1, wherein the air mass-setting actuator is a gas exchange valve.

7. The method according to claim 1, which further comprises detecting an air/fuel ratio in all of the cylinders and individually determining an air/fuel variable for each cylinder.

8. The method according to claim 1, which further comprises detecting a torque generated in all of the cylinders and individually determining a torque variable for each cylinder.

9. A method for controlling an internal combustion engine having cylinders each with at least one fuel injection valve and at least one actuator setting a mass of air supplied to the cylinder, which comprises:

detecting an air/fuel ratio in a cylinder and individually determining an air/fuel variable for each cylinder;

detecting a torque difference variable representing differences between torques generated in the cylinders and individually determining the torque difference variable for each cylinder;

individually correcting an activation of the fuel injection valve for each cylinder as a function of:

a detected quantity of the air/fuel variable for each cylinder; and a desired value of the air/fuel variable; and individually correcting an activation of the air mass-setting actuator for each cylinder as a function of a detected value of the torque difference variable to effect an assimilation of the torques generated by the individual cylinders.

10. The method according to claim 9, which further comprises detecting the air/fuel ratio with at least one sensor.

11. The method according to claim 9, which further comprises detecting the torque difference with at least one sensor.

12. The method according to claim 9, wherein the engine has a crankshaft connected to the cylinders, and which further comprises deriving the torque difference variable from a rotational speed of the crankshaft.

13. The method according to claim 9, which further comprises deriving the torque difference variable from a rotational speed of a crankshaft of the engine.

14. The method according to claim 9, which further comprises deriving the torque difference variable from a measurement signal of a combustion space pressure sensor.

15. The method according to claim 9, wherein each of the cylinders has a combustion space connected to a combustion space pressure sensor, and which further comprises deriving the torque difference variable from a measurement signal of the combustion space pressure sensor.

16. The method according to claim 9, wherein the air mass-setting actuator is a gas exchange valve.

17. The method according to claim 9, which further comprises detecting an air/fuel ratio in all of the cylinders and individually determining an air/fuel variable for each cylinder.

18. The method according to claim 9, which further comprises detecting a torque difference variable representing differences between torques generated in all of the cylinders and individually determining the torque difference variable for each cylinder.

* * * * *